US007072594B2

(12) United States Patent
Hoshi et al.

(10) Patent No.: US 7,072,594 B2
(45) Date of Patent: Jul. 4, 2006

(54) DEVELOPING APPARATUS, PROCESS CARTRIDGE, AND IMAGE FORMING APPARATUS

(75) Inventors: Nobuharu Hoshi, Numazu (JP); Tatsuya Suzuki, Shizuoka-ken (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/878,615

(22) Filed: Jun. 29, 2004

(65) Prior Publication Data

US 2005/0089338 A1 Apr. 28, 2005

(30) Foreign Application Priority Data

Oct. 24, 2003 (JP) ..... 2003-364728

(51) Int. Cl.
*G03G 15/08* (2006.01)

(52) U.S. Cl. ..... 399/27; 399/64; 399/119

(58) Field of Classification Search ..... 399/27, 399/64

See application file for complete search history.

(56) References Cited

U.S. PATENT DOCUMENTS

| | | | | |
|---|---|---|---|---|
| 5,305,064 | A * | 4/1994 | Trott et al. | 399/258 |
| 5,740,499 | A | 4/1998 | Higeta et al. | 399/105 |
| 5,809,374 | A | 9/1998 | Tsuda et al. | 399/111 |
| 6,078,763 | A | 6/2000 | Hoshi | 399/111 |
| 6,442,359 | B1 | 8/2002 | Numagami et al. | 399/111 |
| 6,463,233 | B1 | 10/2002 | Kojima et al. | 399/111 |
| 6,505,007 | B1 | 1/2003 | Miura et al. | 399/27 |
| 6,577,831 | B1 | 6/2003 | Kojima et al. | 399/111 |
| 6,681,088 | B1 | 1/2004 | Kanno et al. | 399/111 |
| 2003/0086715 | A1 | 5/2003 | Miura et al. | 399/27 |
| 2003/0156848 | A1 | 8/2003 | Kawai et al. | 399/27 |
| 2003/0185587 | A1 | 10/2003 | Kawai et al. | 399/111 |

FOREIGN PATENT DOCUMENTS

| | | |
|---|---|---|
| JP | 3-181973 | 8/1991 |
| JP | 2003-131479 | 5/2003 |

* cited by examiner

*Primary Examiner*—David Gray
*Assistant Examiner*—Ryan D. Walsh
(74) *Attorney, Agent, or Firm*—Fitzpatrick, Cella, Harper & Scinto

(57) ABSTRACT

A developing apparatus is for developing a latent image formed on an image bearing member. The apparatus includes: a developer accommodating portion for accommodating the developer; a developing device for developing the latent image; a light transmitting portion, provided in the developer accommodating portion, for transmitting light for detecting a remaining amount of the developer; a first developer feeding member, provided in the developer accommodating portion, for feeding the developer toward the developing means by rotation thereof; and a second developer feeding member for feeding the developer onto a light transmission surface of the light transmitting portion after the first developer feeding member rubs the light transmission surface by a free end with respect to a radial direction of the rotation. The second developer feeding member is provided on a rotation shaft which is also a rotation shaft of the first developer feeding member. The second developer feeding member does not rub the light transmission surface when the second developer feeding member rotates.

15 Claims, 12 Drawing Sheets

DEVELOPING APPARATUS, PROCESS CARTRIDGE, AND IMAGE FORMING APPARATUS

FIELD OF THE INVENTION AND RELATED ART

The present invention relates to a developing apparatus, a process cartridge, and an image forming apparatus.

Here, an image forming apparatus means an apparatus for forming an image on recording medium. For example, it includes an electrophotographic copying machine, an electrophotographic printer (for example, a laser beam printer, an LED printer, etc.), an electrostatic printer, a magnetic recording printer, a facsimile apparatus, a word processor, etc.

A developing apparatus means an apparatus for developing a latent image formed on an image bearing member, with the use of developer.

A process cartridge means a cartridge in which a minimum of a developing means and an electrophotographic photosensitive member are integrally disposed, and which is removably mountable in the main assembly of an image forming apparatus.

In the field of an electrophotographic image forming apparatus employing one of the electrophotographic image formation processes, it has been a common practice to employ a process cartridge system, which integrally places an electrophotographic photosensitive member, and a single or plurality of processing means, which act on an electrophotographic photosensitive member, in a cartridge removably mountable in the main assembly of an electrophotographic image forming apparatus. The employment of this process cartridge system makes it possible for a user himself to maintain an electrophotographic image forming apparatus, without help from service personnel, drastically improving the apparatus in operational efficiency. Thus, a process cartridge system has been widely used in the field of an electrophotographic image forming apparatus.

A process cartridge is enabled to inform a user of the information regarding the amount of the developer remaining therein, in order to facilitate smooth process cartridge exchange. There are various methods for detecting the amount of the developer remainder in a process cartridge. Known as one of such methods is of a beam transmission type (which hereinafter may be referred to simply as transmission type).

At this time, referring to FIG. 13, the structure of a transmission type developer remainder amount detecting apparatus in accordance with the prior art will be described. A beam L is emitted from a beam emitting portion 102 attached to the main assembly of an electrophotographic image forming apparatus. Then, the beam L is guided so that it enters the developer storage portion 70 through the transparent portion 61 of the developer storage portion 70, travels through the developer storage portion 70, exits from the developer storage portion 70 through the transparent portion 62 of the developer storage portion 70, and reaches the beam receiving portion 103, for example, a phototransistor, attached to the image forming apparatus main assembly. The condition under which the beam L is allowed to travel through the developer storage portion 70 is affected by the amount of the developer remaining in the developer storage portion 70. To describe this more concretely, there is a developer conveying member 82 located in the developer storage portion 70 to convey the developer D toward the development roller while stirring the developer D, and when there is a substantial amount of the developer in the developer storage portion 70, the beam L is completely blocked by the developer D. However, as the amount of the developer remaining in the developer storage portion 70 decreases, it becomes possible for the beam L to travel through the developer storage portion 70 for a certain length of time. In other words, the smaller the amount of the developer remaining in the developer storage portion 70, the shorter the length of time the beam L remains blocked by the developer D, that is, the longer the length of time the beam L is allowed to travel through the developer storage portion 70. Thus, by detecting the length of time the beam L is allowed to travel through the developer storage portion 70, it is possible to estimate the amount of the developer remainder in the developer storage portion 70 (Japanese Laid-open Patent Applications 3-181973, 2003-131479 (FIG. 12, P. 9)).

At this time, the developer remainder amount detecting method of a transmission type will be described with reference to FIG. 13.

As will be evident from FIG. 13, the developer conveying member 82 is in the developer storage portion 70, and is rotated in contact with the internal surface of the developer storage portion 70. As the developer conveying member 82 is rotated, it conveys the developer D toward the development roller 22 while wiping the internal surface of the transparent portion 62. As soon as the developer conveying member 82 is moved past the transparent portion 62 while wiping the internal surface of the transparent portion 62, the developer D which was conveyed toward the development roller 22, but did not adhere to the development roller 22, returns to the transparent portion 62, covering the internal surface of the transparent portion 62. The present invention is one of the results of the further development of the prior art regarding a transmission type developer remainder amount detecting method.

SUMMARY OF THE INVENTION

Thus, the primary object of the present invention is to provide a combination of a developing apparatus, a process cartridge, and an image forming apparatus, which makes it possible to precisely detect the amount of the developer remaining in the process cartridge.

Another object of the present invention is to provide a combination of a developing apparatus, a process cartridge, and an image forming apparatus, which makes it possible to make as linear as possible the correlation between the length of time a beam of light is allowed to travel through the developer storage portion of a process cartridge, and the amount of the developer in the process cartridge.

Another object of the present invention is to provide a combination of a developing apparatus, a process cartridge, and an image forming apparatus, which is capable of stabilizing the amount of the developer on the internal surfaces of the transparent portions of the developer storage portion of the process cartridge.

Another object of the present invention is to provide a combination of a developing apparatus, a process cartridge, and an image forming apparatus, in which the developing apparatus comprises: a transparent portion with which the developer storage portion of the process cartridge is provided to detect the amount of the developer in the process cartridge; a first developer conveying member which is placed in the developer storage portion to convey the developer toward the developing means as it is rotated; and a second developer conveying member which is placed in the developer storage portion, being attached to the rotational shaft to which the first developer conveying member is attached, in order to convey the developer to the internal surface, that is, beam exit surface, of the transparent portion after the first developer conveying member wipes the beam exit surface of the transparent portion, by its free edge in terms of the radius direction of the sweeping range of the first developer conveying member, and which does not wipe the beam exit surface of the transparent portion of the developer storage portion while being rotated.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment

[General Description of Image Forming Apparatus]

First, referring to FIG. 12, the general structure of a typical color image forming apparatus will be described.

Figure 12:
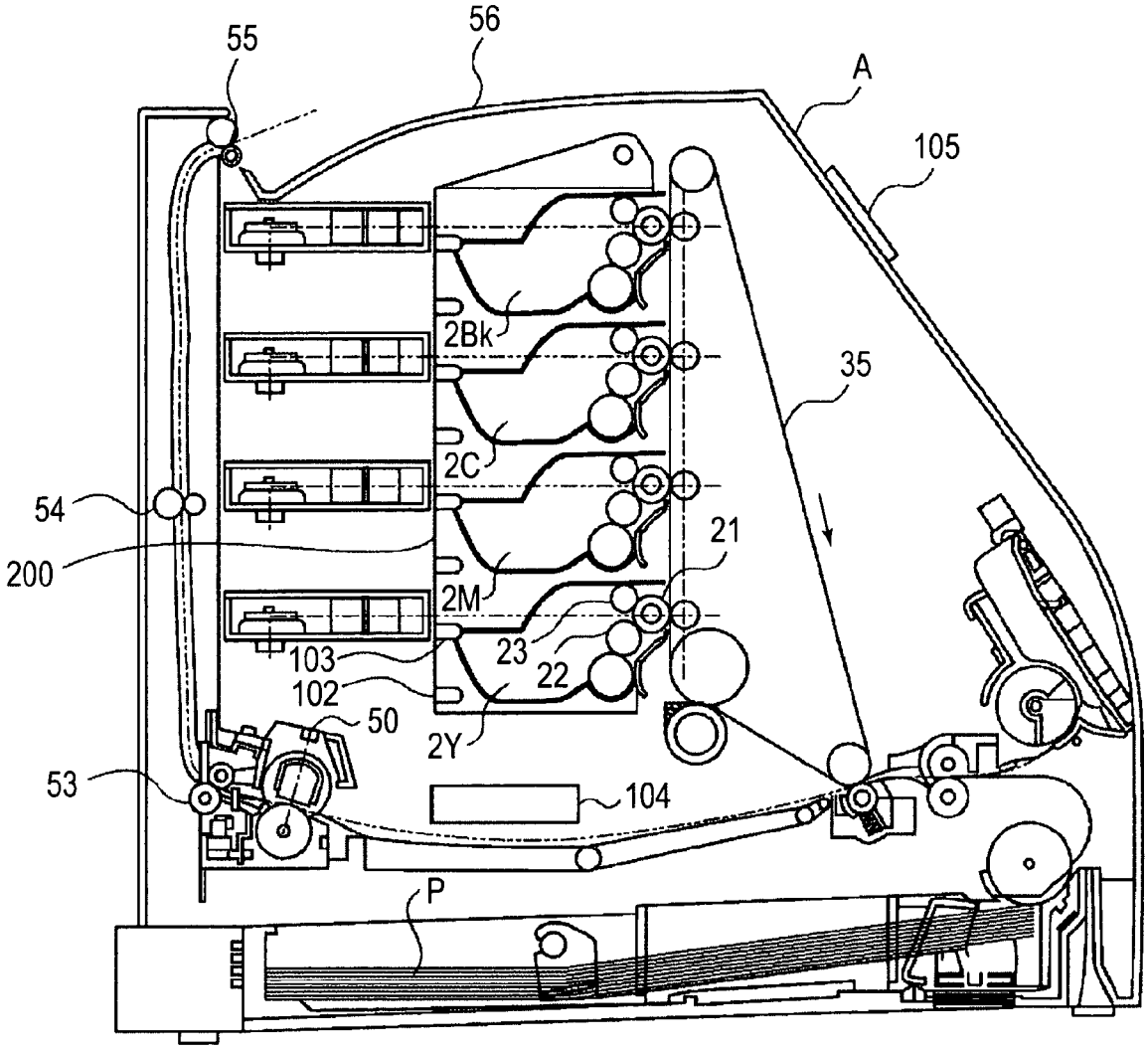
FIG. 12 is a sectional view an image forming apparatus in the preferred embodiment of the present invention, which is forming an image.
Figure 13:
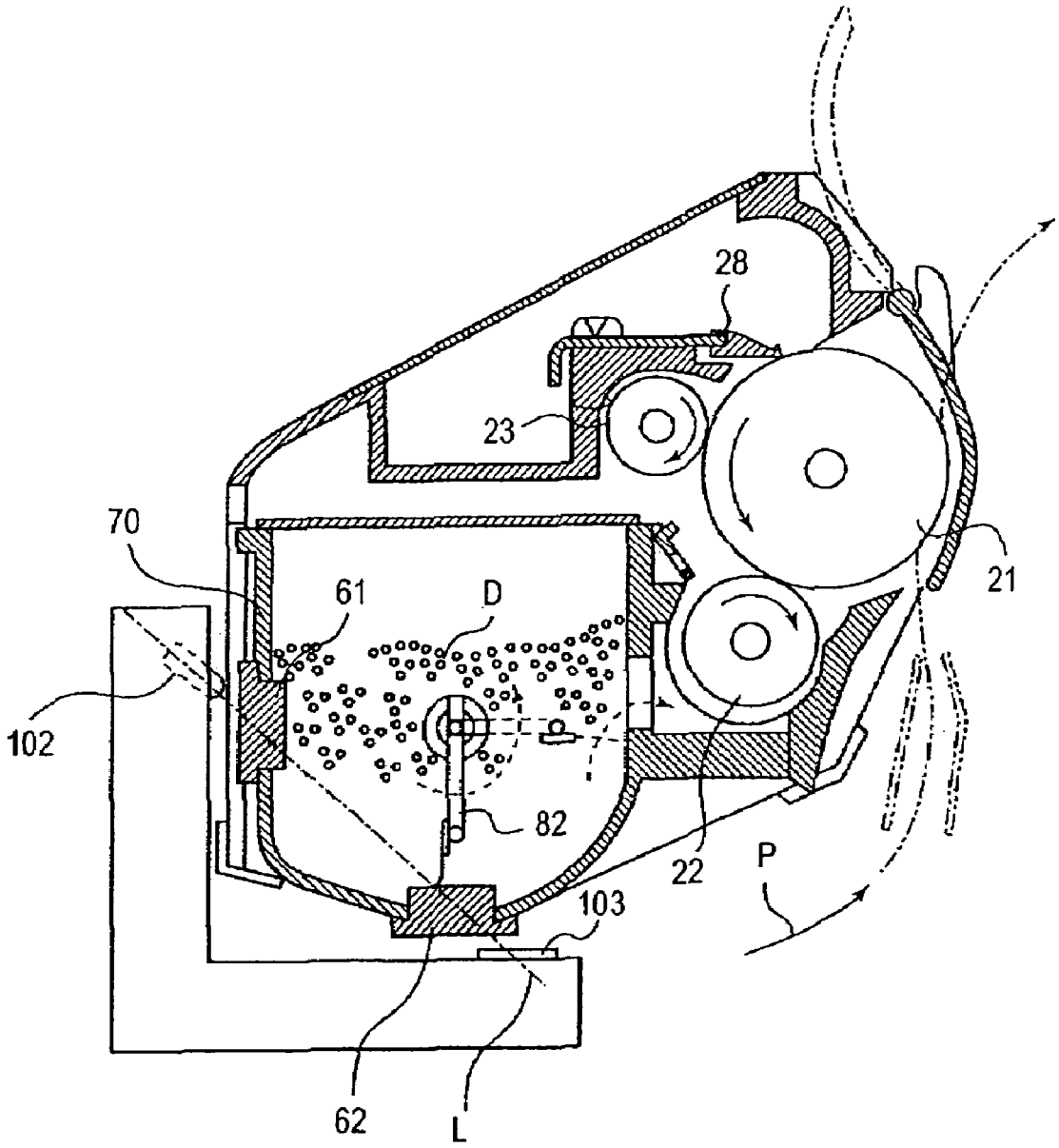
FIG. 13 PRIOR ART
FIG. 13 is a sectional view of the developer storage portion of a process cartridge in accordance with the prior art.

FIG. 12 is a drawing for describing the overall structure of an electrophotographic color image forming apparatus as an example of an image forming apparatus, in which a plurality of process cartridges 2 are in the process cartridge holding portion 200.

As is evident from FIG. 12, the image forming apparatus A has a cartridge holding portion 200 in which process cartridges 2Y, 2M, 2C, and 2Bk are mounted. The process cartridges 2Y, 2M, 2C, and 2Bk, corresponding to the yellow (Y), magenta (M), cyan (C), and black (Bk) color components of a full-color image, respectively, each have a photosensitive drum 21 as an image bearing member. In the image forming apparatus A, multiple images different in color are developed by the cartridges 2, one for one, are transferred in layers onto an intermediary transferring member 35, and are transferred onto a delivered recording medium P. The image forming apparatus A is also provided with a fixing station 50 for fixing the transferred color images, different in color, on the recording medium P to the recording medium P, and multiple pairs of discharge rollers 53, 54, and 55, which discharge the recording medium P onto the delivery tray 56 on top of the apparatus main assembly.

Further, the image forming apparatus A is provided with a beam emitting portion 102 for emitting a beam L for detecting the amount of the remaining developer D, and a beam receiving portion 103 for receiving the beam L having traveled through the internal space of the developer storage portion 70. It is also provided with a CPU (information processing unit) 104 for processing the information regarding the length of time the beam receiving portion 103 received the beam L.

Incidentally, the aforementioned four cartridges 2 different in the color of the developer therein can be individually and removably mountable in the cartridge holding portion 200 of the apparatus main assembly 100.

[Description of Process Cartridge]

Figure 1:
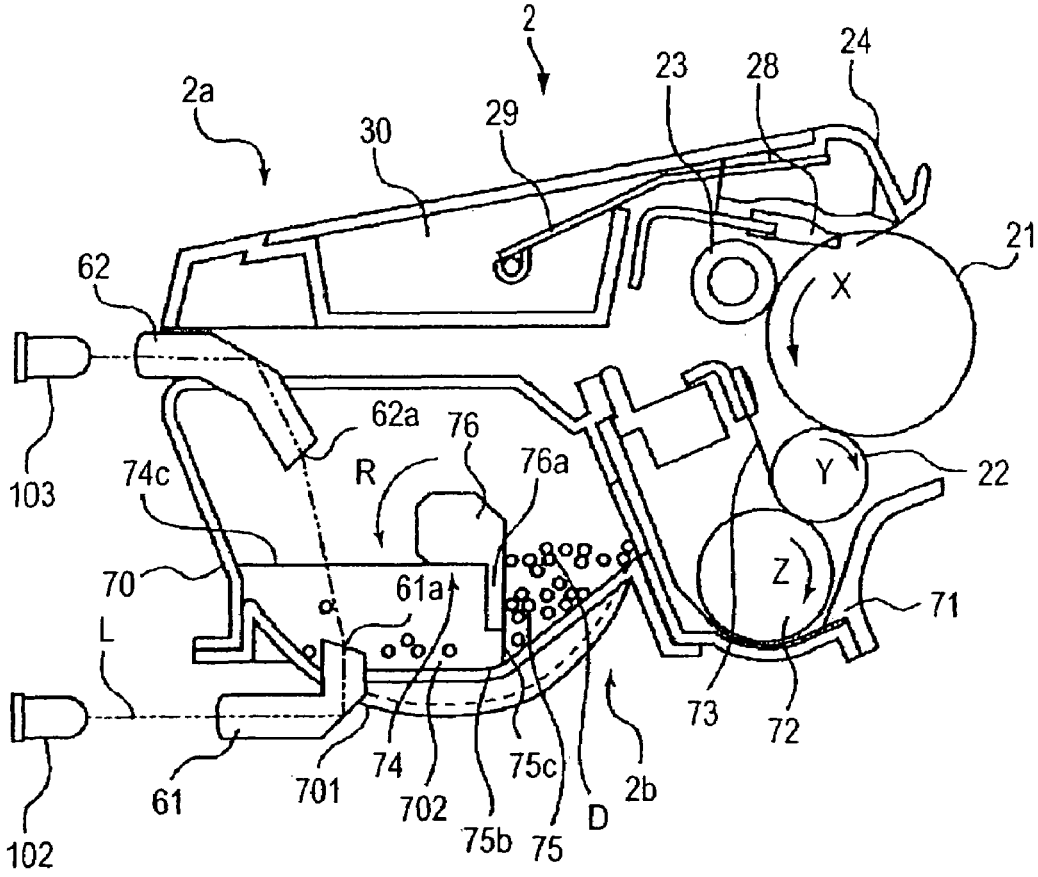
FIG. 1 is a sectional view of the process cartridge in one of the preferred embodiments of the present invention.
Figure 2:
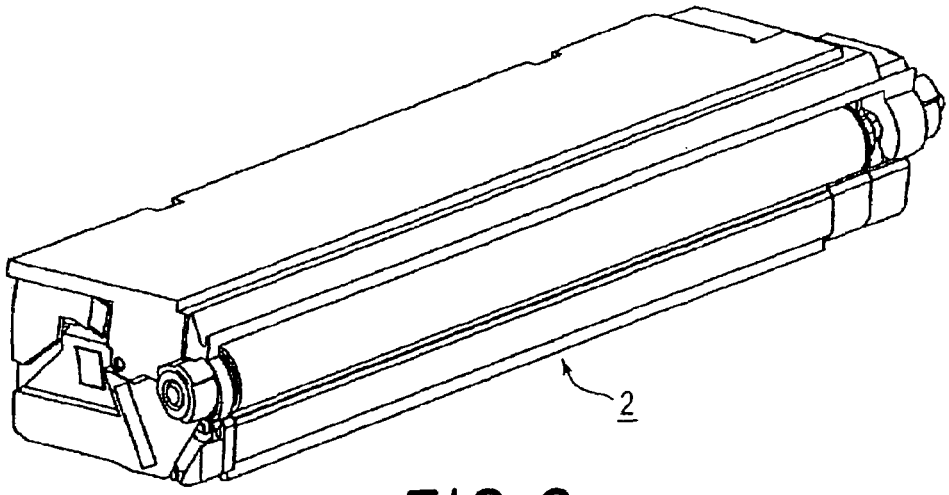
FIG. 2 is a perspective view of the process cartridge in the preferred embodiment of the present invention.
Figure 3:
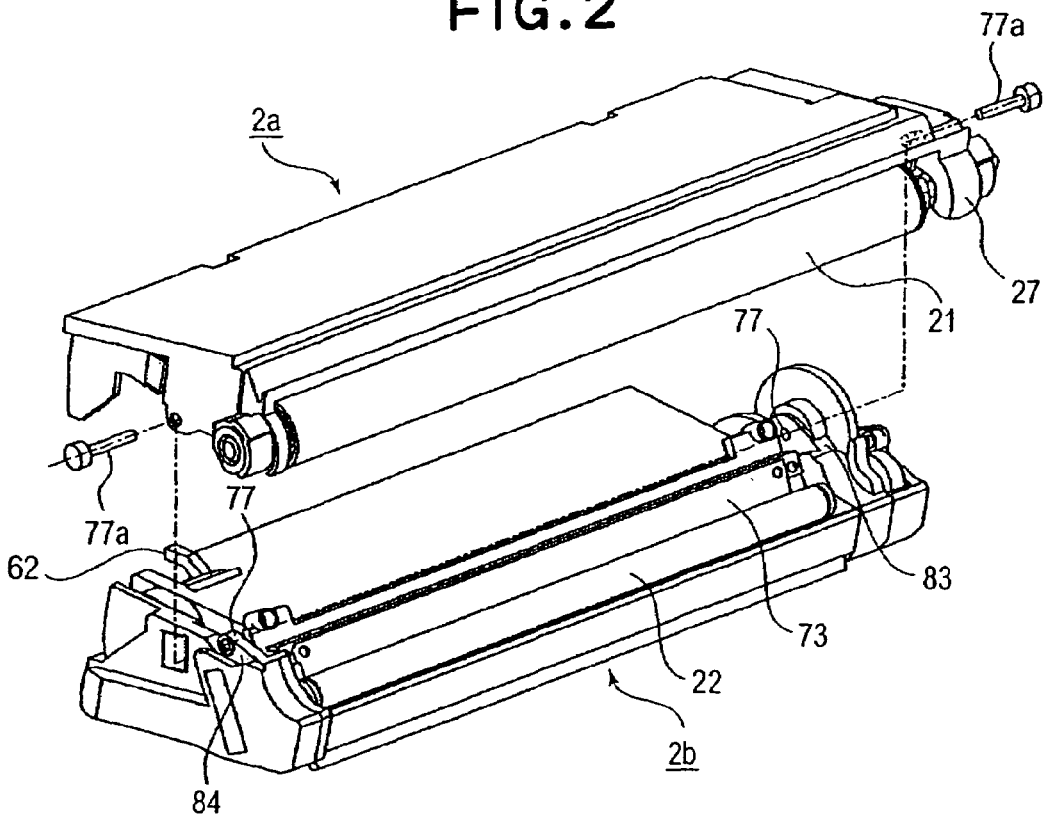
FIG. 3 is a perspective view of the process cartridge in the preferred embodiment of the present invention, the photosensitive drum unit 2*a* and developing apparatus 2*b* of which are separated from each other.

Next, referring to FIGS. 1, 2, and 3, the process cartridge 2 in this preferred embodiment of the present invention will be described in detail. FIG. 1 is a sectional view of the process cartridge 2, and FIG. 2 is a perspective view of the cartridge 2. FIG. 3 is a perspective view of the process cartridge in the preferred embodiment, the photosensitive drum unit 2*a* and developing apparatus 2*b* of which are separated from each other. Incidentally, the four cartridges for yellow, magenta, cyan, and black color components, one for one, are the same in structure.

The cartridge 2 is separable into the photosensitive drum unit 2*a* and development unit 2*b*. The drum unit 2*a* has the electrophotographic photosensitive member 21 (which hereinafter will be referred to as photosensitive drum 21), as an image bearing member, in the form of a drum, a charge roller 23, and a cleaning blade 28, whereas the development unit 2*b* has the development roller 22 (developing means) for developing an electrostatic latent image formed on the photosensitive drum 21.

The drum unit 2*a* has a drum unit frame 24, to which the photosensitive drum 21 is rotatably attached, with a pair of bearings 27 placed between the photosensitive drum 21 and drum unit frame 24. The photosensitive drum 21 comprises an aluminum cylinder, and a layer of organic conductor coated on the peripheral surface of the aluminum cylinder. The charge roller 23 as a primary charging means for uniformly charging the peripheral surface of the photosensitive drum 21 is placed in contact with the peripheral surface of the photosensitive drum 21. Also placed in contact with the peripheral surface of the photosensitive drum 21 is the cleaning blade 28 for removing the developer D (toner) remaining on the peripheral surface of the photosensitive drum 21. The charge roller 23 is of a type which employs one of the contact charging methods. In this embodiment, the charge roller 23 is an electrically conductive roller, and is placed in contact with the peripheral surface of the photosensitive drum 21. As voltage is applied to the charge roller 23, the peripheral surface of the photosensitive drum 21 is uniformly charged. The developer D remaining on the peripheral surface of the photosensitive drum 21 is removed by the blade 28. The removed developer D is continuously conveyed rearward by the developer conveying mechanism 29, to a waste toner chamber 30 located in the rear portion of the drum unit frame 24. The driving force from a motor (unshown) of the apparatus main assembly 100 is transmitted to the photosensitive drum 21, rotating thereby the photosensitive drum 21 in the counterclockwise direction (direction indicated by arrow mark X) in synchronism with an image forming operation.

The development unit 2*b* has the development roller 22, which is rotated (in the direction indicated by arrow mark Y) in contact with the photosensitive drum 21, a developer storage portion 70 in which the developer D is stored, and a developing means container 71. The development roller 22 is rotatably supported by the developing means container 71, with the interposition of a pair of bearings 83 and 84. Placed in contact with the peripheral surface of the development roller 22 are a developer supply roller 72, which is rotated (in the direction indicated by arrow mark Z), and the development blade 73. Further, the development unit 2*b* is provided with a first developer conveying member 74, which is placed in the developer storage portion 70. The first developer conveying member 74 conveys the developer D in the developer storage portion 70, to the developer supply roller 72 while stirring the developer D.

The bearings 83 and 84 attached to the lengthwise ends of the development unit 2*b* are provided with a hole 77, through which a pin 77*a* is put to enable the development unit 2*b* to rotationally move relative to the drum unit 2*a*, about the axial line of the hole 77 (pin 77*a*). When the cartridge 2 is out of the apparatus main assembly 100, the development unit 2*b* is kept pressured by the moment generated by a pair of springs (unshown) provided for keeping the development unit 2*b* pressured in the direction to rotate about the axial line of the hole 77, so that the development roller 22 is kept in contact with the peripheral surface of the photosensitive drum 21.

In a development operation, the developer D stored in the developer storage portion 70 is conveyed to the developer supply roller 72 by the first developer conveying member 74, which is being rotated in contact with the development roller 22, which also is being rotated. As a result, the peripheral surface of the developer supply roller 72, which is bearing the developer D, rubs against the peripheral surface of the development roller 22. Consequently, the developer D on the peripheral surface of the developer supply roller 72 is supplied to the peripheral surface of the development roller 22; the developer D is adhered to the peripheral surface of the development roller 22. As the development roller 22 is rotated, the developer D having adhered to the peripheral surface of the development roller 22 reaches the development blade 73, which regulates the amount by which the developer D is allowed to remain adhered to the peripheral surface of the development roller 22, forming thereby the developer D into a thin layer with a predetermined thickness. Then, as the development roller 22 is further rotated, the thin layer of the developer D reaches the development station, which is the contact area between the peripheral surfaces of the photosensitive drum 21 and development roller 22. To the development roller 22, a development bias (DC voltage) is being applied from a power source (unshown) with which the apparatus main assembly 100 is provided. As a result, the electrostatic latent image on the photosensitive drum 21 is developed by the developer D; the developer D on the peripheral surface of the development roller 22 is adhered to the peripheral surface of the photosensitive drum 21 in the pattern of the latent image. While the developer D is supplied to the peripheral surface of the development roller 22 by the developer supply roller 72, the developer D remaining on the peripheral surface of the development roller 22 is removed by the development supply roller 72, and recovered into the developing means container 71. Then, the recovered developer D is stirred into the main body of the developer D in the developing means container 71, by the first developer conveying member 74.

In the case of a contact developing method, such as the one in this embodiment, in which the development roller 22 is kept in contact with the photosensitive drum 21, it is desired that the photosensitive drum 21 is rigid, whereas the development roller 22 is elastic. As for an elastic roller usable as the development roller 22, there are an elastic roller comprising a core, and a solid rubber layer formed around the core, an elastic roller comprising a core, a solid rubber layer formed around the core, and a resin layer coated on the peripheral surface of the solid rubber layer in consideration of the charging of the developer D, and the like.

(Developer Conveying Member, and Developer Remainder Amount Detection Structure)

Next, referring to FIGS. 4–11, and 14, the first developer conveying member 74, a second developer conveying member 75, and a developer remainder amount detection structure, in the preferred embodiment of the present invention will be described.

Figure 4:
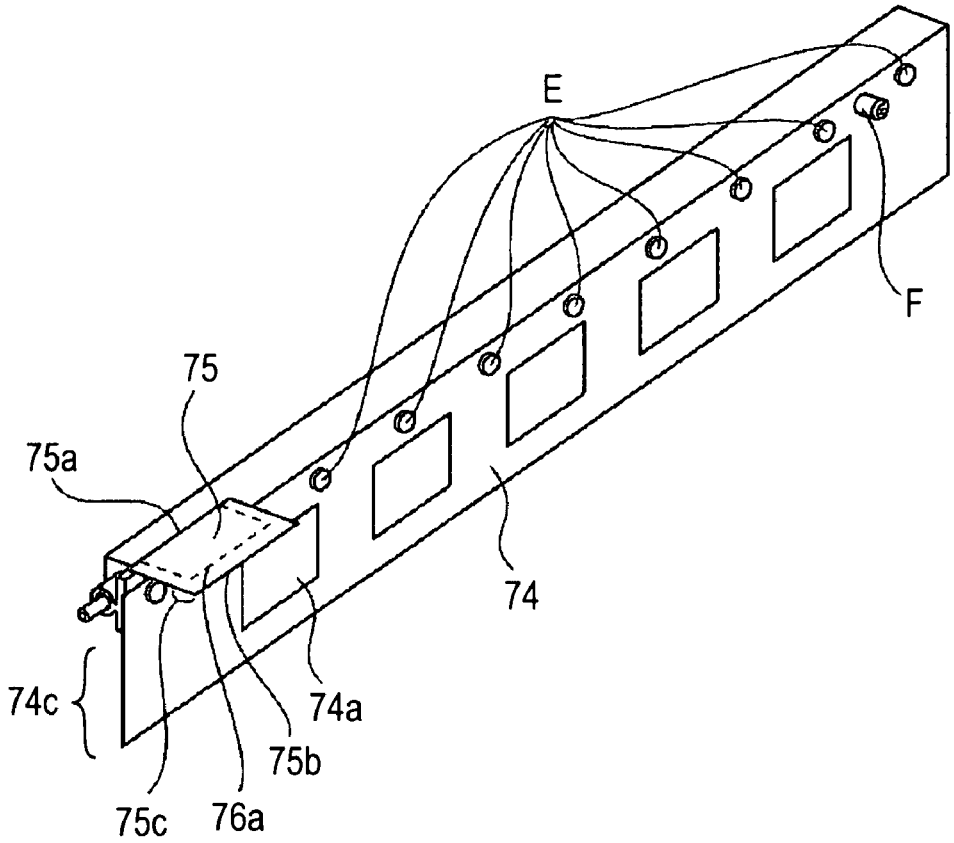
FIG. 4 is a perspective view of the developer conveying member in the preferred embodiment of the present invention.
Figure 5:
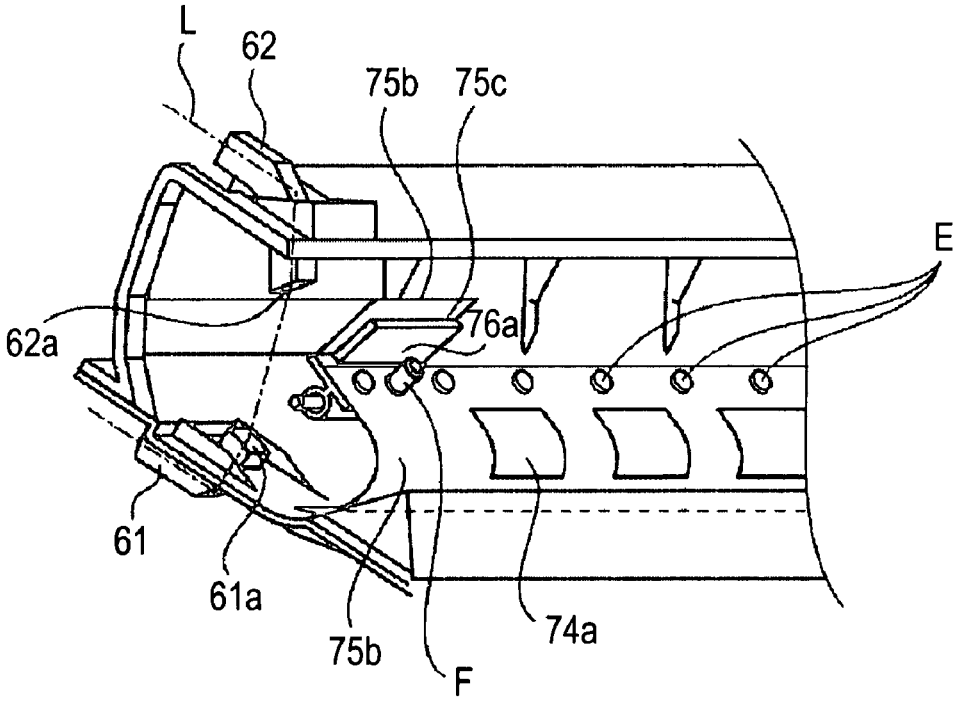
FIG. 5 is a perspective view of the developer remainder amount detecting portion in the preferred embodiment of the present invention, showing the structure thereof.
Figure 6:
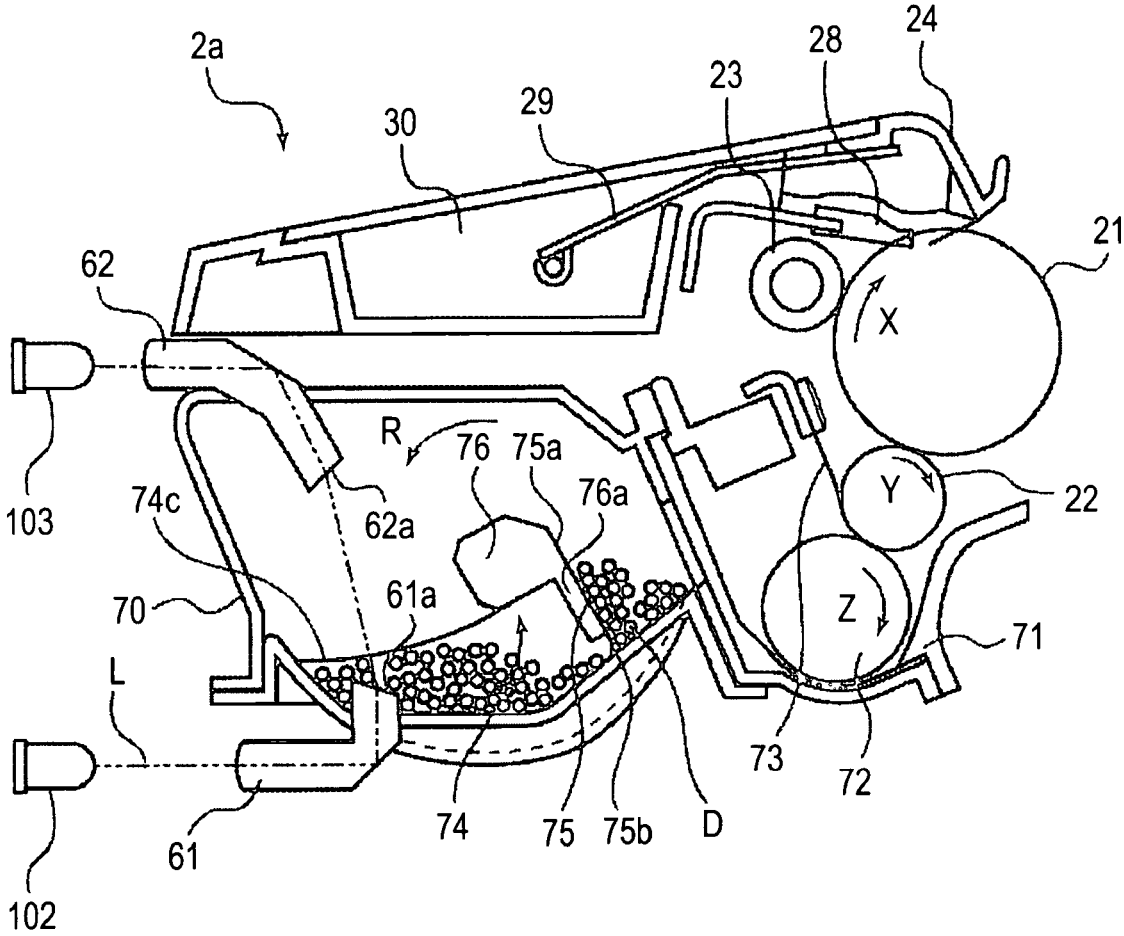
FIG. 6 is a sectional view of the process cartridge in the preferred embodiment of the present invention, showing the state thereof, in which the beam for detecting the amount of the developer remainder is not receivable.
Figure 7:
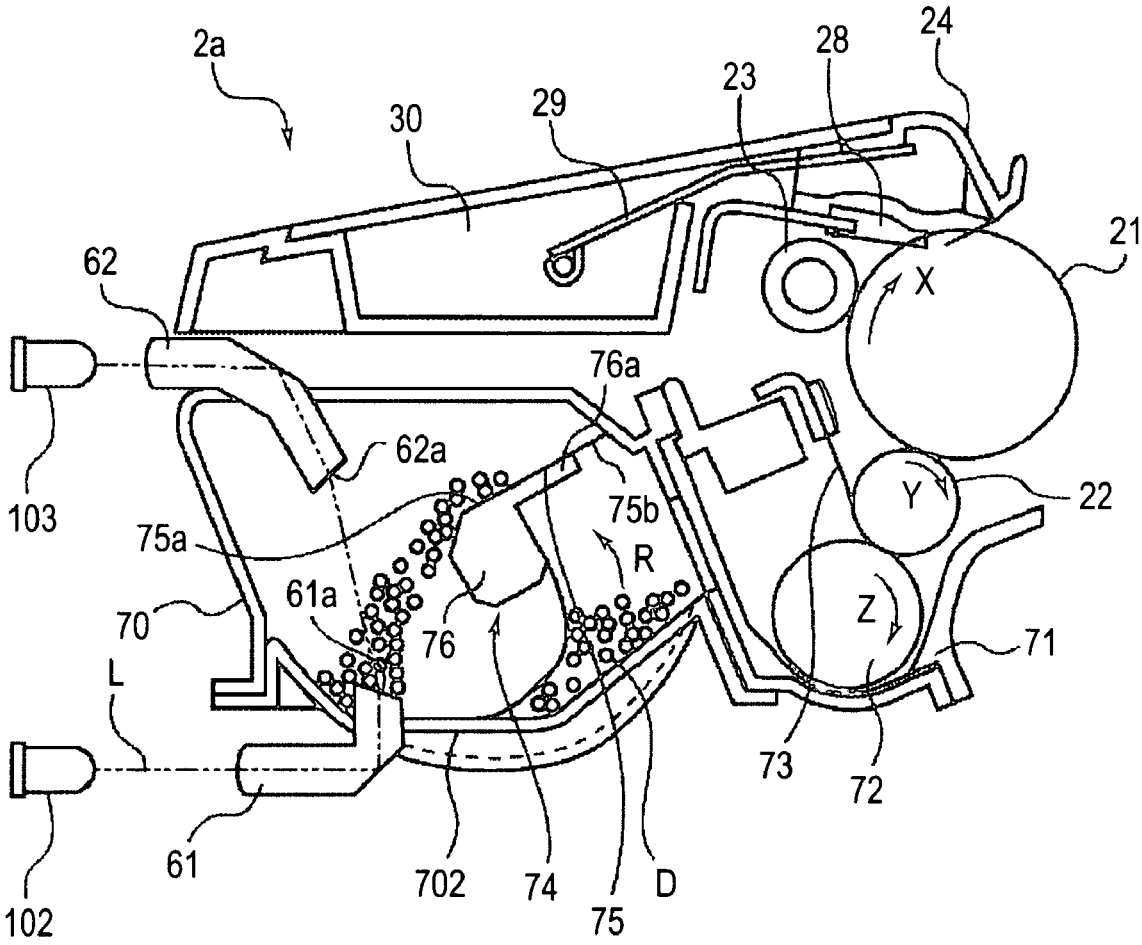
FIG. 7 is a sectional view of the process cartridge in the preferred embodiment of the present invention, showing the state thereof, in which the beam for detecting the amount of the developer remainder is receivable.
Figure 8:
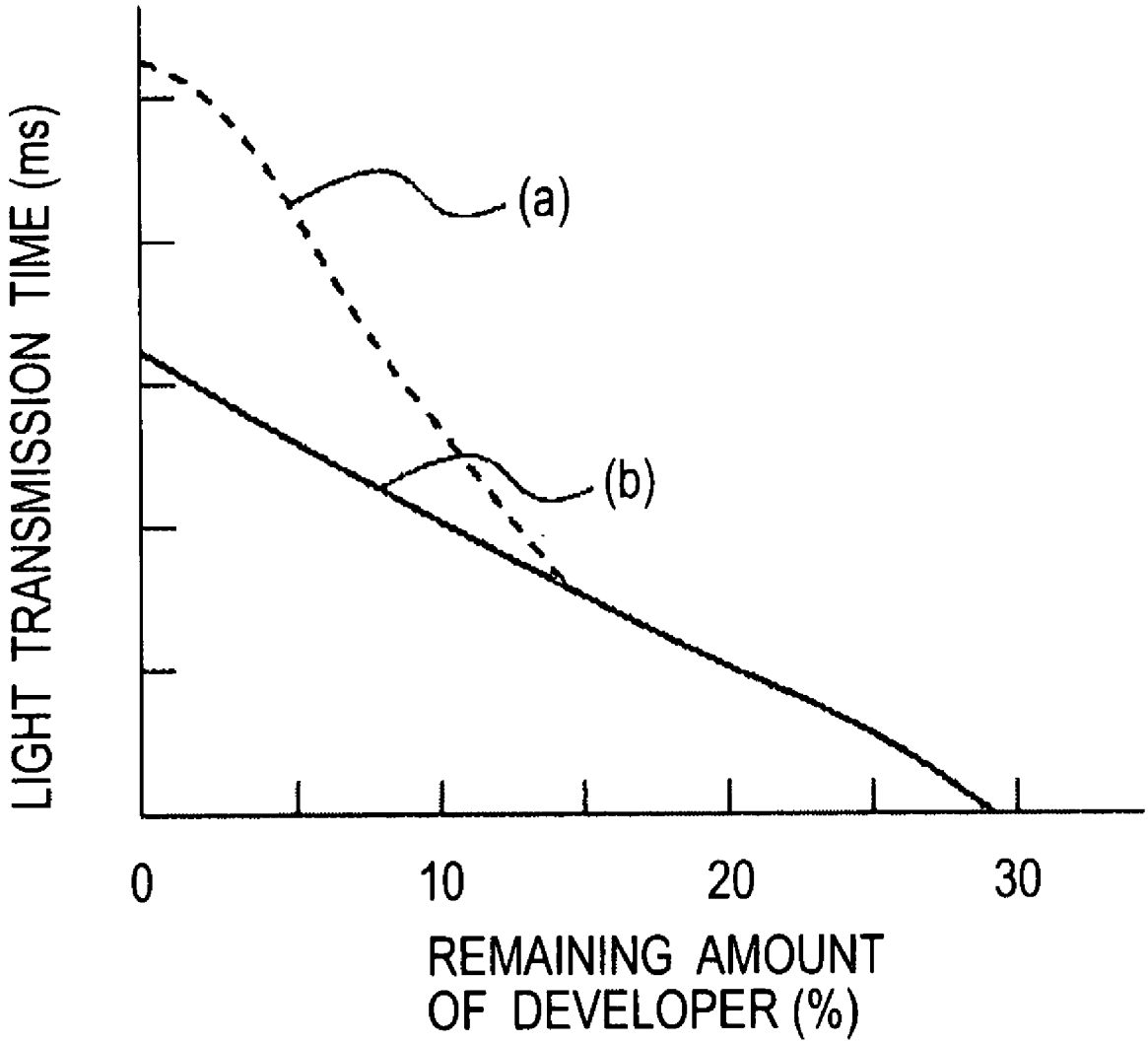
FIG. 8 is a graph showing the relationship between the amount of the developer remainder in the process cartridge and the length of time the beam is allowed to travel through the developer storage portion of the process cartridge, in the preferred embodiment of the present invention.
Figure 9:
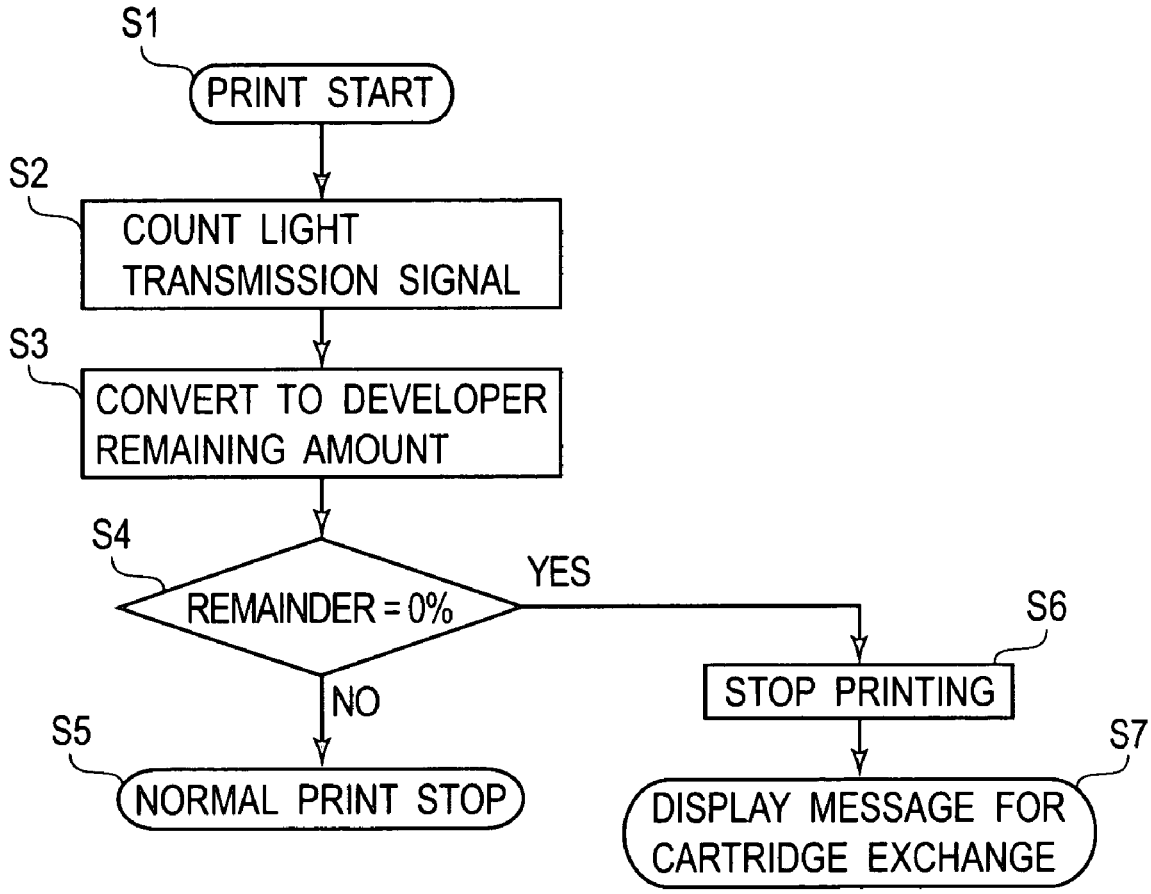
FIG. 9 is a flowchart showing the developer remainder amount detection sequence in the preferred embodiment of the present invention.
Figure 10:
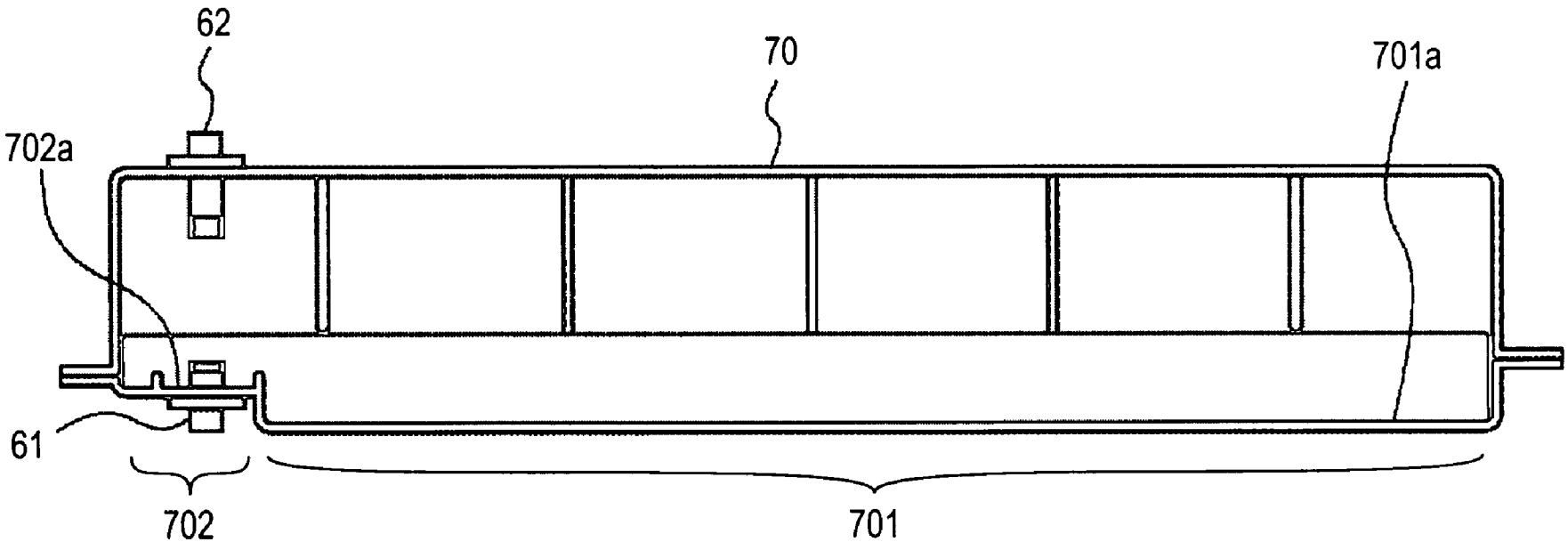
FIG. 10 is a sectional view of the developer storage portion in the preferred embodiment of the present invention.
Figure 11:
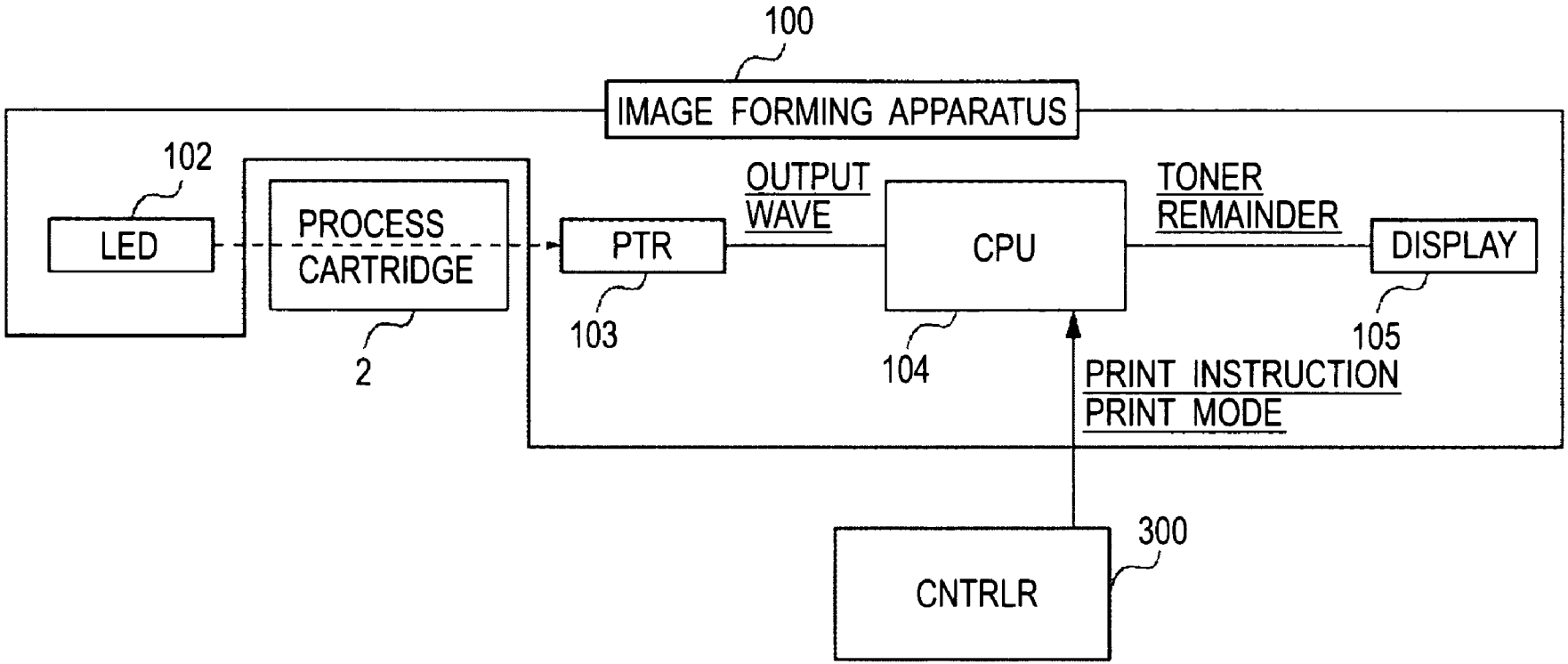
FIG. 11 is a block diagram of the developer remainder amount detection process in the preferred embodiment of the present invention.
Figure 14:
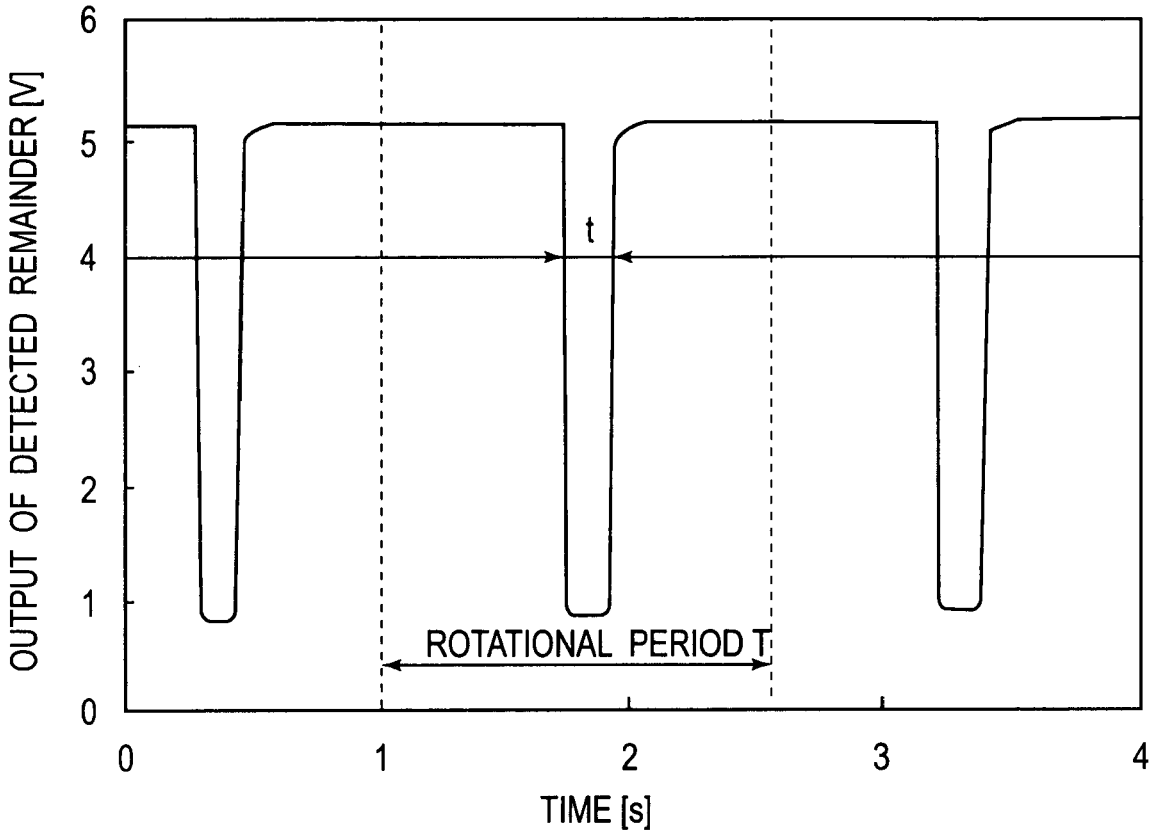
FIG. 14 is a graph showing the relationship between the developer remainder amount and pulse width.

FIG. 4 is a perspective view of the developer conveying member in the preferred embodiment of the present invention, and FIG. 5 is a perspective view of the developer remainder amount detecting portion in the preferred embodiment. FIG. 6 is a sectional view of the process cartridge in the preferred embodiment, showing the state thereof, in which the beam for detecting the amount of the developer remainder is not receivable, and FIG. 7 is a sectional view of the process cartridge in the preferred embodiment, showing the state thereof, in which the beam for detecting the amount of the developer remainder is receivable. FIG. 8 is a graph showing the correlation between the amount of the developer remaining in the process cartridge and the length of time the beam is allowed to travel through the developer storage portion of the process cartridge, and FIG. 9 is a flowchart showing the developer remainder amount detection sequence. FIG. 10 is a sectional view of the developer storage portion in the preferred embodiment, and FIG. 11 is a block diagram of the developer remainder amount detection process. FIG. 14 is a graph showing the relationship between the developer remainder amount and the pulse width.

First, referring to FIGS. 9 and 11, the developer remainder amount detection sequence in the preferred embodiment will be described. As a printer start signal is sent to the CPU 104 as an information processing means from the controller 300 (S1), the beam receiving portion 103 (for example, PRT (photo-transistor)) detects the beam L, which was emitted from the beam emitting portion 102 (for example, LED) and traveled through the developer storage portion 70. The beam receiving portion 103 sends to the CPU 104 the signals representing the amount of the beam detected by the beam receiving portion 103 during a predetermined length of time, or the signals representing the length of time the beam L was allowed to travel through the developer storage portion 70 (S2). Then, the CPU 104 converts these signals into the amount of the remaining developer, based on the relationship between the length of time the beam L is allowed to travel through the developer storage portion 70, and the amount of the remaining developer in the developer storage portion 70, such as the one shown in FIG. 8 (S3). When the amount of the remaining developer has not reached 0% of the full amount, an intended image forming operation is performed (S5). When the amount of the remaining developer has reached 0% of the full amount, the image forming operation is not performed (S6), and the message indicating the necessity of replacing the cartridge 2 is presented on a display 105 as an information displaying means (S7).

The controller 300, beam emitting portion 102, beam receiving portion 103, CPU 104, and display 105 are parts of the apparatus main assembly 100. 0% does not mean that the entirety of the developer D in the developer storage portion 70 has been completely consumed. It includes the state of the cartridge 2, in which the amount of the developer D in the developer storage portion 70 has been reduced to the level at or below which a satisfactory image cannot be formed. Further, a message warning that the cartridge 2 is about to run out of the developer D may be displayed before the amount of the remaining developer in the developer storage portion 70 reaches 0%.

As the information displaying means, the monitor of the PC connected to the image forming apparatus 100, a buzzer, etc., can be used in addition to the display 105 of the apparatus main assembly 100 in this embodiment.

Next, the developer remainder detecting means in this embodiment will be described regarding its structure.

Referring to FIG. 4, there are the first developer conveying member 74, the second developer conveying member 75, and the rotational shaft 76 in the developer storage portion 70. The first developer conveying member 74 conveys the developer D in the developer storage portion 70 toward the development roller 22. The second developer conveying member 75 scoops up the developer D in the developer storage portion 70, and delivers it to the beam exit surface 61*a* of the transparent beam entrance portion 61. In other words, the second developer conveying member 75 drops the developer D it scooped up, onto the beam exit surface 61*a* of the transparent beam entrance portion 61. The first developer conveying member 74 is a piece of flexible sheet formed of resin, and is attached to the rotational shaft 76 by thermal welding, ultrasonic welding, screws, or the like, at the locations E. The rotational shaft 76 is molded of resin. Designated by a referential letter F is a boss used for precisely positioning the first developer conveying member 74 and the rotational shaft 76 relative to each other when attaching the former to the latter. The first developer conveying member 74 is provided with multiple holes 74*a*. The free end portion of the first developer conveying member 74 is elastically bent in contact with the internal surface of the developer storage portion 70. One of the lengthwise ends of the rotational shaft 76 is fitted with a gear (unshown), to which a driving force is transmitted from the apparatus main assembly 100 in order to rotate the rotational shaft 76. As the rotational shaft 76 is rotated, the first developer conveying member 74 is rotated while remaining in contact with the internal surface of the developer storage portion 70 (at least, partially). As a result, the developer D is conveyed toward the development roller 22 by the first developer conveying member 74. When the amount of the developer D in the developer storage portion 70 is large, the developer D partially slips backward through the aforementioned holes 74*a* while being conveyed toward the development roller 22. In other words, the presence of the holes 74*a* controls the amount by which the developer D is conveyed toward the development roller 22, preventing thereby the development roller 22 from being supplied with an excessive amount of the developer D. Further, as the first developer conveying member 74 is rotated, it wipes the beam exit surface 61*a* of the transparent beam entrance portion 61 as the first transparent portion of the developer storage portion 70, and the beam entrance surface 62*a* of the transparent beam exit portion 62 as the second transparent portion of the developer storage portion 70. In other words, as the first developer conveying member 74 is rotated, it removes the developer D adhering to the beam exit surface 61*a* (located inward of developer storage portion 70) of the transparent beam entrance portion 61 as the first transparent portion of the developer storage portion 70, and the beam entrance surface 62*a* (located inward of developer storage portion 70) of the transparent beam exit portion 62 as the second transparent portion of the developer storage portion 70.

Next, referring to FIG. 5, the transparent beam entrance portion 61 and transparent beam exit portion 62 are attached to the developer storage portion 70 so that the beam exit surface 61*a* (inward surface) and beam entrance surface 62*a* (inward surface) are positioned a predetermined distance inward of the developer storage portion 70 relative to the internal surface of the developer storage portion 70. In this embodiment, the transparent beam entrance portion 61 is located on the opposite side of the vertical plane coinciding with the rotational axis of the first developer conveying member 74, from the development roller 22. Further, the transparent beam entrance portion 61 is located below the horizontal plane coinciding with the rotational axis of the first developer conveying member 74. The transparent beam entrance portion 61 guides inward of the developer storage portion 70 the beam L emitted from the beam emitting portion 102 of the apparatus main assembly 100, whereas the transparent beam exit portion 62 guides the beam L having traveled through the developer storage portion 70, to the beam receiving portion 103 of the apparatus main assembly 100. In this embodiment, an LED and a photo-transistor (PTR) are employed as the beam emitting portion 102 and beam receiving portion 103, respectively.

Referring to FIG. 14, the length of time the beam L is allowed to travel through the developer storage portion 70 is detected as the width t of the pulse in the output of the beam receiving portion 103, per rotational cycle T of the first developer conveying member 74. The greater the amount of the beam L, or the length of time the beam L is allowed to travel through the developer storage portion 70, the wider the pulse width t. In other words, as the amount of the developer remaining in the developer storage portion 70 is reduced, the pulse width t becomes greater. Therefore, the CPU 104 calculates the amount of the remaining developer, based on the pulse width t detected by the beam receiving means 103. Then, the display 105 as an information displaying means informs a user of the calculated value.

Next, the second developer conveying member 75 will be described.

The second developer conveying member 75 conveys the developer D to the beam exit surface (inward surface) 61*a* of the transparent beam entrance portion 61, after the first developer conveying member 74 wipes the beam exit surface 61*a*.

If the second developer conveying member 75 is not present, the beam L is sometimes allowed to continue to travel through the developer storage portion 70 during the period between the wiping of the beam exit surface 61*a* by the first developer conveying member 74 and the conveyance of the developer D to the beam exit surface 61*a* by the rotation of the first developer conveying member 74 following the wiping. In this embodiment, therefore, the second developer conveying member 75, which is enabled to convey the developer D to the beam exit surface 61*a* during the above described period, is provided to reduce the length of time the beam L is allowed to travel through the developer storage portion 70.

In other words, if the second developer conveying member 75 is not present, the correlation between the length of time the beam L is allowed to travel through the developer storage portion 70, that is, the length of time the receiving portion 104 receives the beam L, and the amount of the remaining developer, sometimes becomes as indicated by the portion (a) in FIG. 8. However, with the provision of the second developer conveying member 75, the developer D is conveyed to the beam exit surface 61*a* even during the aforementioned period by the second developer conveying member 75. As a result, the correlation between the length of time the beam receiving portion 103 receives the beam L, and the amount of the remaining developer in the developer storage portion 70 is rectified as indicated by the portion (b) in FIG. 8, making it possible to accurately detect the amount of the remaining developer.

In other words, this embodiment makes it possible to keep virtually linear the relationship between the length of time the beam L is allowed to travel through the developer storage portion 70, and the amount of the remaining developer in the developer storage portion 70, from the beginning of the first-time usage of a cartridge 2 to when the amount of the remaining developer becomes zero, making it thereby possible to more accurately detect the amount of the remaining developer than the prior art.

In this embodiment, the dimension of the second developer conveying member 75 is such that its free end does not wipe the beam exit surface 61*a* of the transparent beam entrance portion 61, being therefore better suited for depositing the developer D on the beam exit surface 61*a*. In other words, the first developer conveying member 74 having the function of removing the developer D on the beam exit surface 61*a*, and the second developer conveying member 75 having the function of depositing the developer D on the beam exit surface 61*a* are separated from each other in function, making it thereby possible to more easily and more accurately detect the amount of the remaining developer.

Also in this embodiment, the first developer conveying member 74 is directly attached to the rotational shaft 76, and the second developer conveying member 75 is pasted to the mount 76*a* of the rotational shaft 76 dedicated to the mounting of the second developer conveying member 75, with the use of a piece of two-sided adhesive tape. In other words, both the first and second developer conveying members 74 and 75 are attached to the same rotational member, or the rotational shaft 76. Therefore their rotational axes coincide, making it possible to more accurately detect the amount of the remaining developer, with the addition of only a single component, as described above.

Also in this embodiment, the first developer conveying member 74 wipes the portion of the internal surface of the developer storage portion 70, below the horizontal plane coinciding with the rotational axis of the rotational shaft 76 and on the developing means side of the vertical plane coinciding with the rotational axis of the rotational shaft 76. With the employment of this structural arrangement, the developer D in the developer storage portion 70 can be scooped up by a greater amount, making it easier to more accurately detect the remaining developer amount.

Also in this embodiment, the second developer conveying member 75 is attached to the mount 76*a* of the rotational shaft 76 dedicated to the mounting of the second developer conveying member 75 as described above, and the dimension of the flexible portion 75*c* of the second developer conveying member 75 in terms of the radius direction of the sweeping range of the second developer conveying member 75 is made less than the dimension of the flexible portion 74*c* of the first developer conveying member 74 in terms of the radius direction of the sweeping range of the first developer conveying member 74. Therefore, the second developer conveying member 75 is greater in the amount of the pressure generated in the direction to scoop up the developer D than the first developer conveying member 74, being therefore greater in the capacity to scoop up the developer D. Therefore, it can scoop up the developer D in the developer storage portion 70 by a greater amount, making it easier to more accurately detect the remaining developer amount.

Incidentally, the dimension of the second developer conveying member 75 in terms of the direction parallel to the axial direction of the rotational shaft 76 may be large enough to match the entire length of the developer storage portion 70. In other words, it may be the same as the dimension of the first developer conveying member 74 in terms the direction parallel to the axial direction of the rotational shaft 76. In this embodiment, however, the dimension of the second developer conveying member 75 in terms of the direction of its rotational axis is made shorter than the dimension of the first developer conveying member 74 in terms of the direction of its rotational axis. Further, the second developer conveying member 75 is positioned so that as it is rotated, its free edge moves across the area a predetermined distance away from the beam exit surface 61*a* of the transparent beam entrance portion 61, preventing thereby the provision of the second developer conveying member 75 from sending the developer D toward the development roller 22 by an excessive amount. Therefore, satisfactory development is assured. Also, the deterioration of the developer D is prevented for the following reason: the reduction of the surface area of the second developer conveying member 75 reduces the amount of the load (pressure) which the second developer conveying member 75 applies to the developer D. Further, this embodiment can reduce the cost of the second developer conveying member 75, and the torque necessary to rotate the rotational shaft 76.

Also in this embodiment, in terms of their rotational phase, the first and second developer conveying members 74 and 75 are positioned relative to each other so that after the first developer conveying member 74 wipes the beam exit surface 61*a* of the transparent beam entrance portion 61, the developer D is supplied to the beam entrance surface 61*a* by the second developer conveying member 75. The direction in which the first and second developer conveying members 74 and 75 are rotated is the direction indicated by an arrow mark R in FIG. 1. The developer D used in this embodiment begins to slide downward, as the surface on which the developer D is borne tilts no less than 45°. Therefore, the second developer conveying member 75 is structured so that by the time it becomes necessary for the developer D to be slid downward, the angle of the surface of the second developer conveying member 75 will become no less than 45°. Also in this embodiment, the relationship in terms of rotational phase (difference in angle) between the second developer conveying member 75 and first developer conveying member 74 is desired to be in the range of 60°–120°, preferably, 75°–105°, more preferably, roughly 90°. This angle is the angle between the first developer conveying member 74, and the second developer conveying member 75, in terms of the rotational direction of the rotational shaft 76.

Thus, it is assured that the second developer conveying member 75 is enabled to scoop up the developer D before the first developer conveying member 74 wipes the beam exit surface 61*a* of the transparent beam entrance portion 61, and also, that the developer D scooped up by the second developer conveying member 75 is slid down onto the beam exit surface 61*a* after the beam exit surface 61*a* is wiped by the first developer conveying member 74. Further, it is possible to assure that the amount by which the developer D is supplied to the beam exit surface 61*a*, is limited to the amount just sufficient to prevent the beam L from entering the developer storage portion 70 from the beam exit surface 61*a*.

Next, the developer remainder amount detection process will be described.

As the cartridge 2 receives the driving force from the apparatus main assembly 100, the first developer conveying member 74 is rotated, while remaining in contact with the internal surface of the developer storage portion 70, wiping therefore beam exit surface 61*a*, which is positioned a predetermined distance inward of the developer storage portion 70 relative to the internal surface of the developer storage portion 70. As a result, the developer D adhering to the beam exit surface 61*a* is removed, allowing thereby the beam L to travel through the developer storage portion 70. Then, after the first developer conveying member 74 passes the beam exit surface 61*a*, the developer D, which is being conveyed toward the development roller 22 by the first developer conveying member 74, partially escapes backward through the aforementioned holes 74*a* of the first developer conveying member 74, returning toward the beam exit surface 61*a*. At the same time, the second developer conveying member 75 scoops up the developer D having escaped backward through the holes 74*a* of the first developer conveying member 74 and returning toward the beam exit surface 61*a*, and drops the scooped developer D, onto the beam exit surface 61*a*, covering thereby the beam exit surface 61*a* with the developer D, and therefore, blocking the beam L. Meanwhile, the beam receiving portion 103 on the apparatus main assembly 100 side measures the length of time the beam L is allowed to travel through the developer storage portion 70.

When the amount of the remaining developer is large, the developer D having escaped backward through the aforementioned holes 74 of the first developer conveying member 74 deviates from its straight path and covers the beam exit surface 61*a*, after the first developer conveying member 74 finishes wiping the beam exit surface 61*a*. It should be noted here that the holes 74*a* are located so that they do not directly face the beam exit surface 61*a*, and also, that the holes 74*a* of the first developer conveying member 74 do not overlap with the second developer conveying member 75, in terms of the axial direction of the rotational shaft 76. In other words, the portions of the internal space of the developer storage portion 70, which do not correspond in position to the holes 74*a*, are made greater in the rate at which the developer D is conveyed through them, that is, the level of performance at which the developer D is removed from the beam exit surface 61*a* (level of performance at which the beam exit surface 61*a* is wiped), than the portions of the internal space of the developer storage portion 70, which correspond in position to the holes 74*a*. With the employment of the above described structural arrangement, the length of time the beam L is allowed to travel through the developer storage portion 70 can be increased by removing the developer D on the beam exit surface 61*a*, while preventing the problem that when the amount of the remaining developer is large, the developer D is conveyed toward the development roller 22 by an excessive amount, and also, the problem that when the amount of the remaining developer is large, the developer D is deteriorated as it is conveyed.

On the other hand, when the amount of the remaining developer is small, the amount by which the developer D escapes backward through the holes 74*a* is small, causing thereby the time necessary for the beam exit surface 61*a* to be covered by the developer D, to fluctuate. In a situation such as the above-described one, that is, when the amount of the remaining developer is small, the beam exit surface 61*a* is covered mainly by the developer D that was scooped up by the second developer conveying member 75 and is dropped onto the beam exit surface 61*a* (FIG. 7).

With the employment of the above described structural arrangement, therefore, the correlation between the length of time the beam L is allowed to travel through the developer storage portion 70 and the remaining developer amount in the developer storage portion 70 becomes virtually linear, making it possible to reliably detect the remaining developer amount, across the entire period of cartridge usage (from when remaining developer amount is large to when it will have become small), in which the remaining developer amount is detectable.

Next, the task the second developer conveying member 75 performs after the developer D scooped up by the second developer conveying member 75 slides down on the second developer conveying member 75 and covers the beam exit surface 61*a*, will be described in detail.

As the rotational shaft 76 is rotated, the second developer conveying member 75 scoops up the developer D in the developer storage portion 70. The amount by which the developer D is scooped up by the second developer conveying member 75 is affected by the amount of the remaining developer in the developer storage portion 70. That is, when the remaining developer amount in the developer storage portion 70 is large, the developer D covers the second developer conveying member 75 from the base 75*a* of the second developer conveying member 75 to the free end portion 75*b* of the second developer conveying member 75. On the other hand, when the amount of the remaining developer in the developer storage portion 70 is small, the developer D reaches only the free end portion 75*b* of the second developer conveying member 75. Further, when the amount of the remaining developer is large, the developer D scooped up by the portion of the second developer conveying member 75 next to the base 75*a* begins to slide down on the second developer conveying member 75, and fall onto the transparent beam entrance portion 61, covering the beam exit surface 61*a*, relatively earlier. However, as the amount of the developer D in the developer storage portion 70 gradually decreases, the amount by which the developer D is scooped up by the second developer conveying member 75 also gradually decreases. As the amount of the developer D in the developer storage portion 70 decreases to the level at which only the free end portion 75*b* touches the developer D, the length of time from when the developer D begins to slide down on the second developer conveying member 75 to when it reaches the beam exit surface 61*a* becomes substantial, making the length of time necessary for the beam exit surface 61*a* to be covered with the developer D longer than when a large amount of the developer D is on the second developer conveying member 75 (length of time the beam L is allowed to travel through developer storage portion 70 becomes longer).

As described above, the length of time it takes for the developer D scooped up by the second developer conveying member 75 to slide down on the second developer conveying member 75 and cover the beam exit surface 61*a* (the length of time the beam L is allowed to travel through developer storage portion 70) is affected by the amount by which the developer D is scooped up by the second developer conveying member 75.

Referring to FIG. 8, when the second developer conveying member 75 was not present, as the amount of the developer in developer storage portion 70 became smaller, the correlation between the length of time the beam receiving portion 103 received the beam L, and the amount of the remaining developer, became as represented by the chain line portion (a). In comparison, when the second developer conveying member 75 was provided as in this embodiment, the correlation remained virtually linear as represented by the solid line portion (b), until the amount of the remaining developer became zero, making it possible to reliably detect the remaining developer amount.

Next, the relationship between the developer storage portion 70 and transparent beam entrance portion 61 will be described. In this embodiment, the internal surface of the developer storage portion 70 is not flat; the internal surface of the developer storage portion 70 has irregularities in terms of the lengthwise direction thereof. That is, the transparent beam entrance portion 61 is attached to the developer storage portion 70 so that the beam exit surface 61*a* is placed a predetermined distance inward of the developer storage portion 70 relative to the internal surface of the developer storage portion 70 (FIGS. 1 and 10). More specifically, the transparent beam entrance portion 61 is attached to the portion 702 of the developer storage portion 70, and the developer storage portion 70 is structured so that the internal surface 702*a* of the portion 702 is positioned closer to the axial line of the rotational shaft 76 (more upward in FIGS. 1 and 10) than the internal surface 701*a* of the portion 701, that is, the internal surface of the portion of the developer storage portion 70 other than the portion 702.

With the employment of the above described structural arrangement, it is possible to prevent dead spaces, which overlap with the transparent beam entrance portion 61 in terms of the lengthwise direction of the developer storage portion 70, from being created. Therefore, it is possible to reduce the developer storage portion 70 in the size of the space it occupies. This structural arrangement is particularly effective in the case of such an image forming apparatus as a color laser beam printer that employs multiple cartridges.

The employment of the above described structural arrangement sometimes makes the apparent amount of the remaining developer appear smaller than the actual amount of the remaining developer. Even in such cases, the provision of the second developer conveying member 75 makes it possible to accurately detect the remaining developer amount. Further, even if the beam exit surface 61*a* of the transparent beam entrance portion 61 is positioned inward of the developer storage portion 70 relative to the internal surface 701*a* of the bottom portion of the developer storage portion 70 by a distance substantially greater than the distance by which the beam exit surface 61*a* is positioned inward of the developer storage portion 70 relative to the internal surface 701*a*, the above described effects can be obtained.

Next, the above described preferred embodiment will be summarized.

A developing apparatus (development unit) 2*b* for developing a latent image formed on the photosensitive drum 21 as an image bearing member, further comprises:

the developer storage portion 70 for storing the developer D;

the development roller 22 as a developing means for developing the latent image with the use of the developer D;

the transparent beam entrance portion 61, with which the said developer storage portion 70 is provided to allow the beam for detecting the amount of the remainder of the developer D in the developer storage portion 70, to travel through the developer storage portion 70;

the first developer conveying member 74 placed in the developer storage portion 70 to convey the developer D toward the development roller 22 as a developing means, and wipe the beam exit surface 61*a* of the transparent beam entrance portion 61; and the second developer conveying member 75 placed in the developer storage portion 70 to convey the developer D to the beam exit surface 61*a* after the first developer conveying member 74 wipes the beam exit surface 61*a*.

The second developer conveying member 75 does not wipe the beam exit surface 61*a*.

The first and second developer conveying members 74 and 75 are attached to the rotational shaft 76, being thereby rotatably placed in the developer storage portion 70, so that the rotational axes of the first and second developer conveying members 74 and 75 coincide with that of the rotational axis of the rotational member 76.

The second developer conveying member 75 is flexible, and scoops up the developer D while rubbing the internal surface of the developer storage portion 70, in the area below the horizontal plane coinciding with the rotational axis of the rotational shaft 76 and on the same side as the side where the development roller 22 as a developing means is placed, with respect to the vertical plane coinciding with the axial line of the rotational shaft 76.

The dimension of the second developer conveying member 75 in terms of the direction parallel to the rotational axis of the rotational shaft 76 is smaller than the dimension of the first developer conveying member 74 in terms of the direction parallel to the rotational axis thereof. Further, in terms of the direction parallel to their rotational axes, the second developer conveying member 75 is positioned so that as it is rotated, it moves through the area directly above the beam exit surface 61*a*.

The first developer conveying member 74 is provided with the multiple holes 74*a* through which the developer D is allowed to escape in the direction opposite to the rotational direction of the first developer conveying member 74, and which are not located so that they correspond in position to the beam exit surface 61*a*.

The transparent beam entrance portion 61 is located on the opposite side of the vertical plane coinciding with the rotational axis of the rotational shaft 76, from the development roller 22 as a developing means, and below the horizontal plane coinciding with the rotational axis of the rotational shaft 76.

The second developer conveying member 75 begins to scoop up the developer D before the first developer conveying member 74 begins to wipe the beam exit surface 61*a*. Further, the second developer conveying member 75 conveys the developer D it scooped up, to the beam exit surface 61*a* after the first developer conveying member 74 wipes the beam exit surface 61*a*.

The beam exit surface 61*a* is positioned inward of the developer storage portion 70, relative to the internal surface of the developer storage portion 70.

Incidentally, in the above-described embodiment, the first transparent portion of the developer storage portion 70 is the portion of the developer storage portion 70, through which the beam L is guided into the developer storage portion 70, and the second transparent portion of the developer storage portion 70 is the portion of the developer storage portion 70, through which the beam L is guided out of the developer storage portion 70 after traveling through the developer storage portion 70. However, the first transparent portion may be used as the portion through which the beam L is guided out of the developer storage portion 70, and the second transparent portion may be used as the portion through which the beam L is guided into the developer storage portion 70. Such an arrangement provides the same effects as those described above. Although the preceding embodiment was described with reference to a process cartridge, the present invention is also applicable to a developing apparatus itself. Also in this embodiment, the first and second developer conveying members were described as pieces of a flexible sheet. However, they may be pieces of felt. Also in this embodiment, the image bearing member is described as an electrophotographic photosensitive member. However, the image bearing member may be an electrostatically recordable member on which a latent image can be borne. Further, the shape of the image bearing member does not need to be limited to the drum shape; the image bearing member may be in the form of a sheet, a belt, or the like.

As described above, the present invention makes it possible to provide a combination of a developing apparatus, a process cartridge, and an image forming apparatus, which makes it possible to accurately detect the amount of the remaining developer.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 364728/2003 filed Oct. 24, 2003, which is hereby incorporated by reference.

What is claimed is:

1. A developing apparatus for developing a latent image formed on an image bearing member, said apparatus comprising:

a developer accommodating portion configured to accommodate a developer;

a developing device configured and positioned to develop the latent image;

a light transmitting portion, provided in said developer accommodating portion, configured and positioned to transmit light for detecting a remaining amount of the developer;

a first developer feeding member, provided in said developer accommodating portion, configured and positioned to feed the developer toward said developing device by rotation thereof; and a second developer feeding member configured and positioned to feed the developer onto a light transmission surface of said light transmitting portion after said first developer feeding member rubs the light transmission surface by a free end thereof with respect to a radial direction of the rotation, said second developer feeding member being provided on a rotation shaft which is also a rotation shaft of said first developer feeding member, wherein second developer feeding member does not rub said light transmission surface when said second developer feeding member rotates, wherein said second developer feeding member is flexible and is effective to scoop up the developer while rubbing an inner surface of said developer accommodating portion at a position which is below a horizontal plane passing through a center of rotation of the rotation shaft and which is in the same side as said developing device with respect to a vertical plane passing through the center of rotation of the rotation shaft.

2. An apparatus according to claim 1, wherein said second developer feeding member has a length measured in a direction in which the rotation shaft extends, which is shorter than the length of said first developer feeding member measured in the direction in which the rotation shaft extends, and wherein said second developer feeding member is disposed with respect to the direction in which the rotation shaft extends such that said second developer feeding member passes at least through a region which is opposed to said light transmission surface.

3. An apparatus according to claim 1, wherein said first developer feeding member is provided with a hole for permitting the developer to pass in a direction opposite to a rotational direction thereof, and wherein said hole is positioned so as not to directly face said light transmitting portion.

4. An apparatus according to claim 1, wherein said light transmitting portion is disposed in a side opposite from a side in which said developing device is provided with respect to a vertical plane passing through the center of rotation of the rotation shaft and below a horizontal plane passing through the center of rotation of the rotation shaft.

5. An apparatus according to claim 1, wherein said second developer feeding member starts scooping the developer before said first developer feeding member starts rubbing said light transmission surface, and said second developer feeding member feeds the scooped developer onto said light transmission surface after said first developer feeding member rubs said light transmission surface.

6. An apparatus according to claim 1, wherein said light transmission surface is disposed inwardly away from an inner surface of said developer accommodating portion.

7. An apparatus according to claim 1, wherein a free length of said second developer feeding member is shorter than a free length of said first developer feeding member, as measured in a radial direction of the rotation of the rotation shaft.

8. A process cartridge detachably mountable to a main assembly of an electrophotographic image forming apparatus, said process cartridge comprising:

an electrophotographic photosensitive member;

a developer accommodating portion configured to accommodate a developer for developing an electrostatic latent image formed on said electrophotographic photosensitive member;

a developing device configured and positioned to develop the electrostatic latent image using the developer;

a light transmitting portion, provided in said developer accommodating portion, configured and positioned to transmit light to detect a remaining amount of the developer;

a first developer feeding member, provided in said developer accommodating portion, configured and positioned to feed the developer toward said developing device by rotation thereof; and a second developer feeding member configured and positioned to feed the developer onto a light transmission surface of said light transmitting portion after said first developer feeding member rubs said light transmission surface by a free end with respect to a radial direction of the rotation thereof, said second developer feeding member being provided on a rotation shaft which is also a rotation shaft of said first developer feeding member, wherein said second developer feeding member does not rub said light transmission surface when said second developer feeding member rotates, wherein said second developer feeding member is flexible and is effective to scoop up the developer while rubbing an inner surface of said developer accommodating portion at a position which is below a horizontal plane passing through a center of rotation of the rotation shaft and which is in the same side as said developing device with respect to a vertical plane passing through the center of rotation of the rotation shaft.

9. A process cartridge according to claim 8, wherein said second developer feeding member has a length measured in a direction in which the rotation shaft extends, which is shorter than the length of said first developer feeding member measured in the direction in which the rotation shaft extends, and said second developer feeding member is disposed with respect to the direction in which the rotation shaft extends such that said second developer feeding member passes at least through a region which is opposed to said light transmission surface.

10. A process cartridge according to claim 8, wherein said first developer feeding member is provided with a hole for permitting the developer to pass in a direction opposite to a rotational direction thereof, and wherein said hole is positioned so as not to directly face said light transmitting portion.

11. A process cartridge according to claim 8, wherein said light transmitting portion is disposed in a side opposite from a side in which said developing means is provided with respect to a vertical plane passing through the center of rotation of the shaft and below a horizontal plane passing through the center of rotation of the shaft.

12. A process cartridge according to claim 8, wherein said second developer feeding member starts scooping the developer before said first developer feeding member starts rubbing the light transmission surface, and said second developer feeding member feeds the scooped developer onto said light transmission surface after said first developer feeding member rubs said light transmission surface.

13. A process cartridge according to claim 8, wherein said light transmission surface is disposed inwardly away from an inner surface of said developer accommodating portion.

14. A process cartridge according to claim 8, wherein a free length of said second developer feeding member is shorter than a free length of said first developer feeding member, as measured in a radial direction of the rotation of the rotation shaft.

15. An electrophotographic image forming apparatus for forming an image on a recording material, to which a process cartridge is detachably mountable, said apparatus comprising:

(i) an emitting portion configured to emit light;

(ii) a mounting portion configured and positioned to detachably mount the process cartridge, the process cartridge including:

a developer accommodating portion configured to accommodate a developer;

a developing device configured and positioned to develop the latent image;

a light transmitting portion, provided in the developer accommodating portion, configured and positioned to transmit light for detecting a remaining amount of the developer;

a first developer feeding member, provided in the developer accommodating portion, configured and positioned to feed the developer toward the developing device by rotation thereof; and a second developer feeding member configured and positioned to feed the developer onto a light transmission surface of the light transmitting portion after the first developer feeding member rubs the light transmission surface by a free end with respect to a radial direction of the rotation thereof, the second developer feeding member being provided on a rotation shaft which is also a rotation shaft of the first developer feeding member, wherein the second developer feeding member does not rub the light transmission surface when the second developer feeding member rotates, wherein the second developer feeding member is flexible and is effective to scoop up the developer while rubbing an inner surface of the developer accommodating portion at a position which is below a horizontal plane passing through a center of rotation of the rotation shaft and which is in the same side as the developing device with respect to a vertical plane passing through the center of rotation of the rotation shaft;

(iii) a light receiving portion configured and positioned to receive light having been emitted from said emitting portion and having passed through an inside of the developer accommodating portion and through the light transmitting portion;

(iv) a notification device configured and positioned to notify a user of a remaining amount of the developer on the basis of information from said light receiving portion; and (v) a feeding device means configured and positioned to feed the recording material.

* * * * *